US005568760A

United States Patent [19]

Volzer

[11] Patent Number: 5,568,760

[45] Date of Patent: Oct. 29, 1996

[54] FLUID POWER CYLINDER WITH POSITION INDICATOR

[75] Inventor: Johannes Volzer, Heroldstatt, Germany

[73] Assignee: Festo KG, Essling, Germany

[21] Appl. No.: 431,406

[22] Filed: Apr. 28, 1995

[30] Foreign Application Priority Data

Aug. 2, 1994 [DE] Germany ..... 9412435 U

[51] Int. Cl.[6] ..... F01B 25/26

[52] U.S. Cl. ..... 92/5 R; 92/165 PR

[58] Field of Search ..... 92/5 R; 91/1

[56] References Cited

U.S. PATENT DOCUMENTS

| | | | |
|---|---|---|---|
| 4,756,229 | 7/1988 | Drakeley | 91/1 |
| 4,854,218 | 8/1989 | Stoll | 91/1 |
| 4,876,945 | 10/1989 | Stoll et al. | 91/1 |
| 4,896,584 | 1/1990 | Stoll et al. | 92/5 R |
| 5,455,509 | 10/1995 | Semura et al. | 92/5 R |

FOREIGN PATENT DOCUMENTS

| | | | |
|---|---|---|---|
| 2056692 | 3/1981 | United Kingdom | 92/5 R |
| 2106984 | 4/1983 | United Kingdom | 92/5 R |
| 4007037 | 3/1994 | WIPO | 92/5 R |

*Primary Examiner*—Thomas E. Denion
*Attorney, Agent, or Firm*—Hoffmann & Baron

[57] ABSTRACT

A fluid power cylinder whose piston rod has on its outer periphery at least one axially extending surface section having the form of a flat. Such surface section has a longitudinal groove, which contains a magnetic strip able to be scanned by a sensor device on the housing. The magnetic strip has alternatingly arranged poles areas in succession, which can be scanned without contact by the sensor device. The magnetic strip is covered by a cover band fixed on the piston rod and consisting of a material allowing the passage of a magnetic field, whose external surface facing away from the magnetic strip constitutes at least a part of the piston rod's surface section having the form of a flat.

20 Claims, 2 Drawing Sheets

FLUID POWER CYLINDER WITH POSITION INDICATOR

BACKGROUND OF THE INVENTION

The invention relates to a fluid power cylinder comprising a housing, a piston in said cylinder adapted to run axially therein, a piston rod, said rod being connected with said piston and extending from the cylinder at one end thereof at least, said piston rod possessing on the external periphery thereof at least one surface section extending in the axial direction and having the form of a flat, a longitudinal groove being provided in said section, and a measuring scale received in said groove and being capable of being scanned by a sensor device integral with the housing.

THE PRIOR ART

A fluid power cylinder of this type is disclosed in the German patent publication 9,209,980.7 U. It is fitted with a displacement measuring system, which renders possible a determination of the position of the piston or of the piston rod. It comprises for example a scale in the form of a resistance element,which is accommodated in a longitudinal groove in the piston rod and is engaged and sensed by a wiper contact functioning as a sensor device.

Owing to the wiping action along the resistance element, gradual wear thereof will take place. This will cause the accuracy of position determination to deteriorate and may lead to leaks at the piston rod where the same emerges through the respective end plate of the housing.

SHORT SUMMARY OF THE INVENTION

One object of the invention is accordingly to create a fluid power cylinder, which has a reduced wear rate while nevertheless permitting a continuous, accurate determination of the position of the piston rod and/or of the piston.

In order to achieve these and/or other objects appearing from the present specification, claims and drawings, in the present invention said scale is embodied in the form of a magnetic strip which comprises a plurality of magnetic zones arranged in alternating succession and magnetized with axially alternating poles, which may be sensed by the sensor device without contact and the magnetic strip is covered by a cover band fixed to the piston rod and consisting of a material allowing the passage of a magnetic field, whose external surface facing away from the magnetic strip constitutes at least a part of the surface section of the piston rod having the form of a flat.

Owing to the cooperation of the sensor device with the magnetic strip magnetized with an alternating succession of poles there will be an extremely accurate and reliable determination of position even at relatively high piston rod speeds. The sensor device will conveniently comprise a plurality of semiconductor sensors, as for instance Hall sensors, which are so arranged on the housing of the fluid power cylinder that when the piston rod is on the move it will be pervaded by the magnetic fields, with different polarities, of the magnetic strip and will yield signals able to be evaluated or processed by processing electronic circuitry. Owing to the contact-free scanning it is possible to prevent all wear whatsoever of the parts contributing to position determination. The additional cover band arranged over the magnetic strip has the further effect that the magnetic strip is protected against damage even on passing through an end plate fixed to the housing and a guiding and sealing arrangement provided here while at the same time providing for an optimum sealing action in the part where the piston rod runs through the end plate of the cylinder, the quality of such sealing effect being just as good as that of a seal on a conventional piston rod. The cover band constitutes at least one component of the surface section, possessing the form of a flat and having the longitudinal groove, of the piston rod and is consequently a component of the external surface of the piston rod, said component being able to cooperate with the above mentioned guiding and/or sealing arrangement in a known manner. In this respect there is the advantageous possibility of manufacturing the cover band of a material complying the tribological requirements and which is equivalent to the basic material for the piston rod as regards resistance to wear and corrosion. In fact the piston rod in accordance with the invention is exteriorly hardly any different to a conventional piston rod, although the magnetic strip, which is very liable to mechanical damage, is accommodated therein protected on all sides. Since the cover strip consists of a material allowing the passage of a magnetic field as for example a material with a relatively low permeability, the magnetic fields of the individual magnet zones are not impaired, or not impaired to any substantial extent, by the cover.

The integration of the magnetic strip in the piston rod renders possible an adherence to the industrial standard dimensions prescribed for the piston rod. Limitations in function as compared with fluid power cylinders of conventional design are not to be expected so that, compared with conventional systems, the service life characteristics are not restricted in any way despite the use of a displacement measurement arrangement. The same applies for the load capacity of the fluid power cylinder.

The presence of the surface section having the form of a flat is furthermore a cheap way of preventing twisting of the piston rod so that the magnetic strip always keeps to the correct position in relation to the sensor device arranged on the housing. Since the cover strip can be designed to resist high mechanical loads, it is possible furthermore even for high torques acting on the piston rod to be compensated for without impairing the accuracy of position determination.

Advantageous further developments of the invention are described in the claims.

An overall form of the fluid power cylinder which is relatively simple to produce is one in which the cover strip is at least partially and preferably completely let into the longitudinal groove in the flat or, respectively, linear surface section. Owing to the interlocking action, produced in this case, between the cover strip and the piston rod the cover strip is reliably fixed in place.

A material which is more particularly suitable for the cover strip is spring steel, as for example 13 X RM 19 steel as supplied by the Sandvik Company.

As a particularly advantageous way of securing the magnetic strip a bond is found to be suitable, in the case of which both parts are connected to the piston rod by means of a high strength adhesive.

In accordance with a further advantageous form of the invention the sensor device is equipped with a sensor head containing the respective sensors, and which as a rule may be integrated in an end plate of the housing constituted by a cap. Electronic signal processing circuitry can be integrated directly in the sensor head, signal amplification and other evaluation being possible in the sensor head itself, something which involves the advantage of very good signal stability.

Further advantageous developments and convenient forms of the invention will be understood from the following detailed descriptive disclosure of embodiments thereof in conjunction with the accompanying drawings.

LIST OF THE SEVERAL VIEWS OF THE DRAWING

DETAILED ACCOUNT OF WORKING EMBODIMENTS OF THE INVENTION

Figure 1:
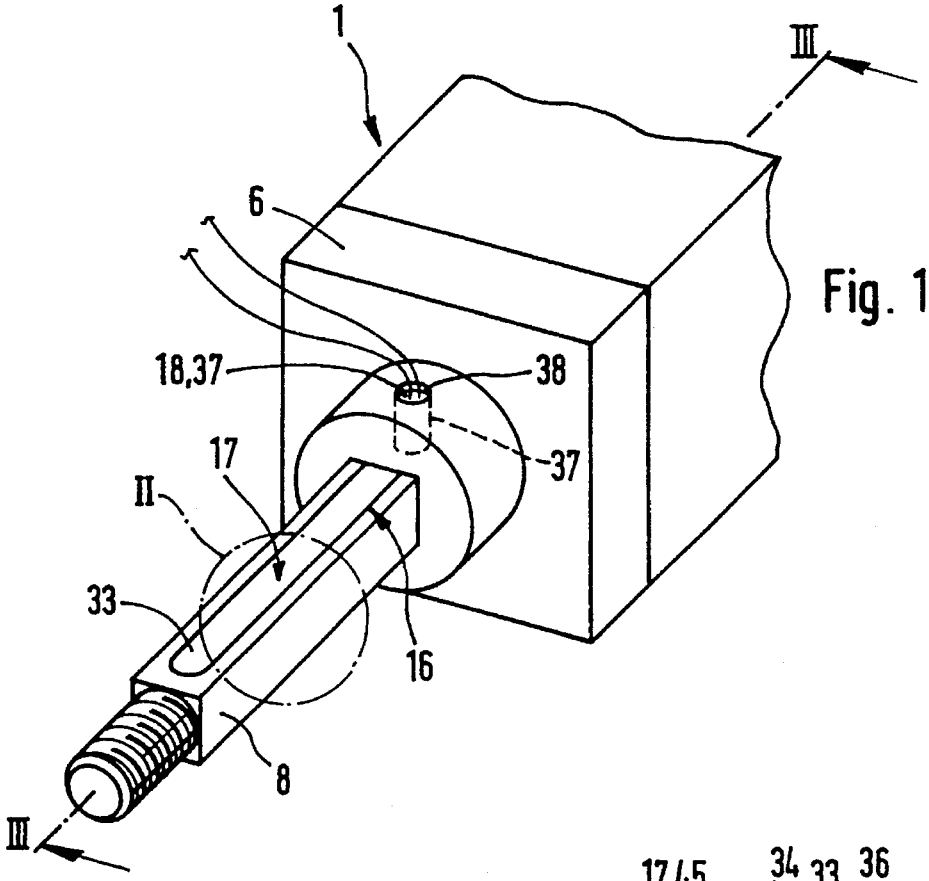
FIG. 1 shows the housing part through which the piston rod extends of a first embodiment of the fluid power cylinder in accordance with the invention.

The fluid power cylinder illustrated by way of example comprises a housing 1, in which a piston 2 is arranged for axial reciprocating motion. The piston 2 divides two working spaces 3 and 4 sealingly from one another, into which a respective housing duct 5 opens, such duct permitting, in a familiar manner, the supply and removal of drive fluid such as compressed air.

The two ends of the housing 1 are closed by terminating walls 6 and 7, which are designed in the form of removable caps.

A piston rod 8 is secured to the piston 2, and extends in the axial direction through the one terminating wall 6 coaxially to the outer face.

The terminating wall 6 is a bearing wall, which supports and guides the piston rod 8 in the transverse direction. For this purpose a guide device 13 is arranged in the passage opening 12, through which the piston rod 2 extends in the terminating wall, said guide device 13 being arranged supported on the housing and constituting a bushing for the piston rod 8. Furthermore a sealing device 14 is located in the passage opening 12 and is for instance designed as part of the structure of the guide device 13. Such sealing device 14 is on the other hand fixed on the terminating wall 6 and on the other hand is in dynamic sealing contact with the piston rod 8. It ensures that drive fluid is not able to escape from the adjoining working space 3 via the passage opening 12 to the outside.

The guide and/or sealing device 13 and 14 might be arranged at least partially outside the passage opening 12 as well.

At the end of the piston rod 8 which is outside the housing 1, an attachment part 15 is provided. It renders possible the application of any desired component to be moved by the fluid power cylinder.

The fluid power cylinder is equipped with a position determining device generally referenced 16. It is here a question of a displacement measuring system, which renders it possible to ascertain the displacement performed by the piston rod 8 or, respectively, the current position thereof. This in turn renders possible a displacement-dependent control and actuation of the fluid power cylinder.

Preferably on its outer periphery the piston rod 8 possesses at least one axially extending surface section 17 having the form of a flat. This flat, linear surface section 17 extends over at least a major part of the length of the piston rod 8 and is at least so arranged and designed that independently of the respective axial position of the piston 2 or, respectively, of the piston rod 8, it always has part of its length radially opposite to a sensor device 18 fixed to the housing 1. Said sensor device 18 is in the present working embodiment of the invention arranged on the terminating wall functioning as a bearing cap.

The sensor device 18 cooperates with a magnetic scale for determination of position, said strip being arranged in an axially extending longitudinal groove 23 in a surface section 17 having the form of a flat. During axial movement of the piston rod 8 the sensor device 18 will practically run along the magnetic scale 22 and will be operated by same so that sensor signals will be produced, which may be processed in any desired fashion in an adjoining processing device 24. For instance it is possible for the sensor signals to be processed for the operation of valves, which for their part control the operation of the fluid power cylinder in a manner dependent on the current position within a stroke.

The magnet strip 22 is in the form of a plastic-bonded part and it is a question of a plastic strip with magnetizable components or particles, which in principle is comparable with a magnetic tape for video and acoustic recording. However it does preferably possess a certain inherent strength and stiffness of its own. In the illustrated working embodiment of the invention it is carried as a laminated structure on a support strip 25, which preferably consists of non-magnetic material and in the working embodiment is a steel tape. The strip unit, consisting of the of the magnetic strip 22 and the support strip 25, is set in the longitudinal groove 23 with the support strip 25 on top, its flat lower surface being turned toward the flat groove floor 27. The width of the groove is equal to the sheet of the strip and furthermore the length of the groove is the same as the length of the strip. It is in this manner that the strip unit is held in place in the longitudinal groove 23 in the plane of the strip without any possibility of movement. The attachment in the longitudinal groove 23 is preferably provided for by a high strength bond, which ensures that the magnetic strip 22 keeps its position in relation to the piston rod 8, even in the case of heavy vibrations at all times.

Figure 2:
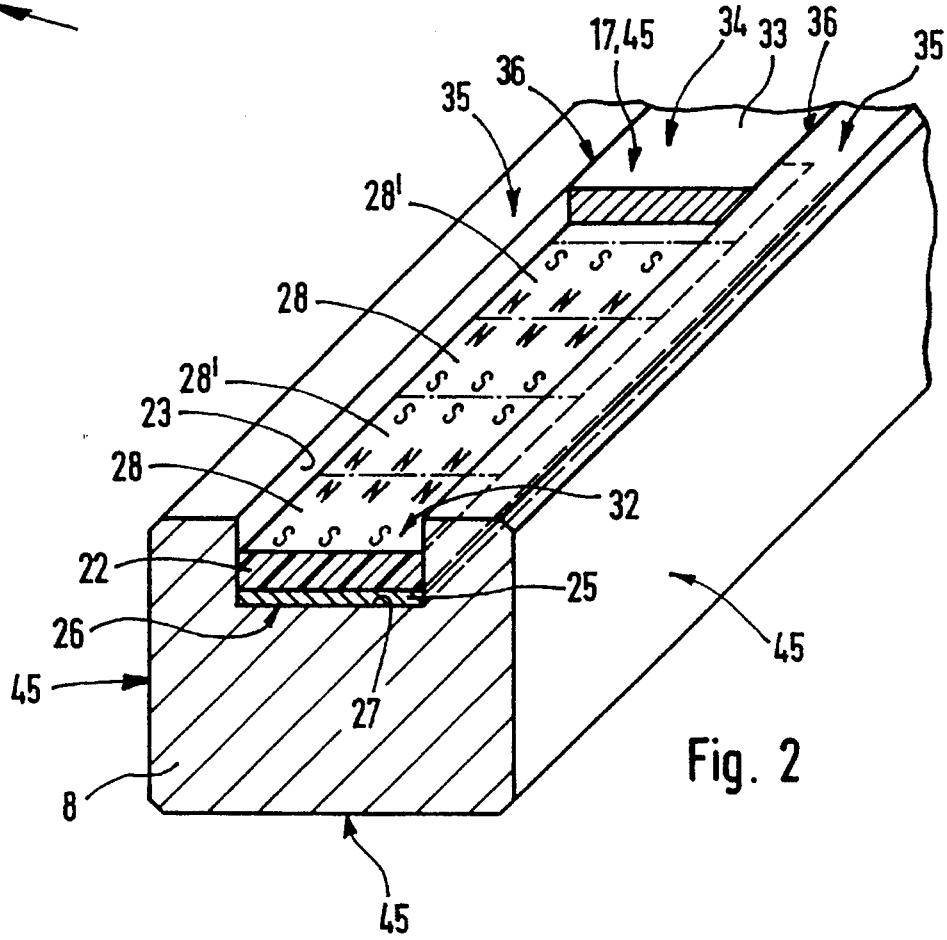
FIG. 2 shows the part marked II in figure of the piston rod on a larger scale, the cover band not being illustrated for its entire length in order to show the magnetic strip.
Figure 3:
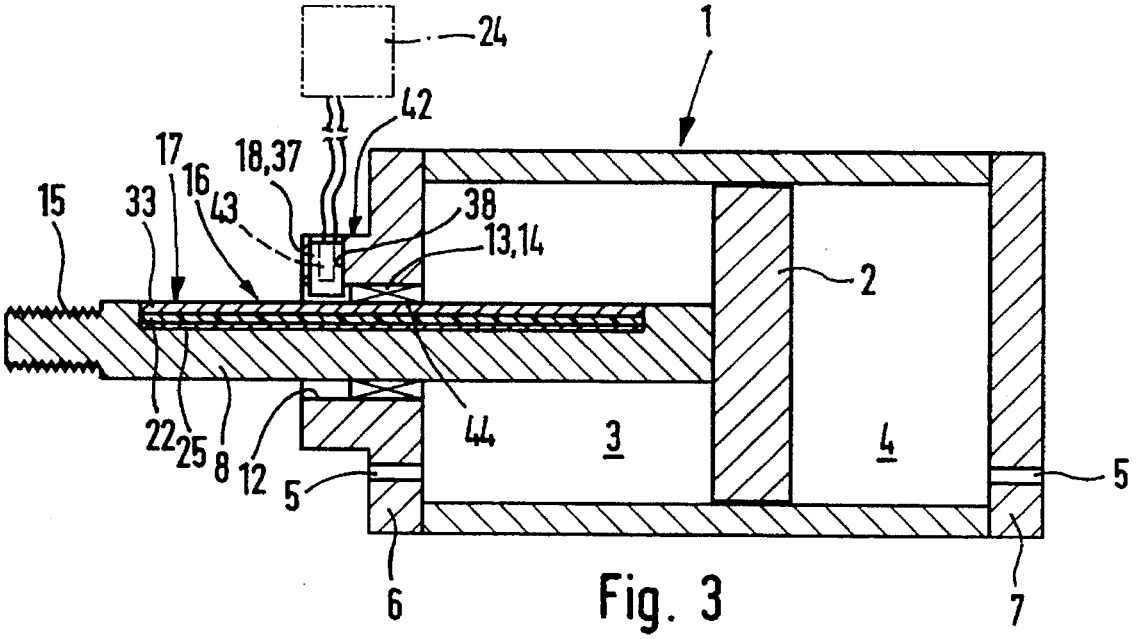
FIG. 3 is a longitudinal section taken through the fluid power cylinder in accordance with FIG. 1 taken along the section line III—III.

By suitable magnetization the magnetic strip 22 is divided into a plurality of sequentially placed magnetized zones 28 and 28', the magnetization of the individual magnetic zones being with alternating poles. The direction of the magnetic field of any two magnetic field zones 28 and 28' adjacent to each other in the longitudinal direction of the strip is consequently different, since the north and south poles are changed over. In the illustrated working embodiment of the invention the individual magnetic field zones 28 and 28' are axially aligned, that is to say the north poles (N) and south poles(S) thereof are aligned in the longitudinal direction of the strip and therefore in the axial direction of the piston rod 8. Preferably the magnetic orientation is such that sequentially arranged magnetic field zones 28 and 28' with identical alignment are placed next to each other. In FIG. 2 the transitions between respectively adjacent magnetic field zones 28 and 28' are indicated in chained lines, which in practice are naturally not to be seen. It will be seen that the north pole end of a respective magnetic field zone is opposite the north pole end of an adjoining magnetic field zone.

The sensor device 18 is so placed in the terminating wall 6 that it is opposite to the top side 32, opposite to the floor of the groove 27, of the magnetic strip 22 is opposite to the plane of the strip at a right angle and with a clearance. During a stroke of the piston 2 the magnetic strip 22 is accordingly moved past the sensor device 18 in the longitudinal direction, said device being affected in succession by the magnetic fields reproduced under the influence of the individual magnetic field zones 28 and 28'. These magnetic fields pervade the sensor device 18, which in the working example comprises two semiconductor sensors, not illustrated in detail, sensitive to magnetic fields, for example a Hall sensor or a field plate sensor. In accordance with the division up, shown as an example, of the magnetic strip 22, the two semiconductor sensors, which are generally arranged perpendicularly to each other, of the sensor device 18 provide two sine signals offset by 90°, which dependent on the fine interpolation pitch of a following electronic evaluating system may be finely interpolated with the desired resolution of for example 0.01 mm. The signals received therefore provide information about the current position of the piston rod 8 and each part connected with same.

Since the scanning of the magnetic strip 22 by the sensor device 18 takes place without making contact, the components of the position determining device 16 are practically free from any mechanical wear and ensure a long working life of the fluid power cylinder.

The thickness of the strip unit comprising the magnetic strip 22 and the support strip 25 is in the illustrated working embodiment less than the depth of the longitudinal groove 23 receiving same. The magnetic strip 22 is therefore mounted in the longitudinal groove 23 with a clearance from the surface section 17 having the form of a flat. The remaining part of the depth of the longitudinal groove 23 is occupied by a cover band 33, which is fitted in the longitudinal groove 23 and rests on the magnetic strip 22. Preferably, the arrangement is such that the cover band 33 is fully taken up in the longitudinal groove 23 as will appear from the working examples herein. The longitudinal groove is in this case just fully filled by the cover band 33, the magnetic strip 22 and the support strip 25 so that the external surface 34, opposite to the magnetic strip 22, of the cover band 33 is flush with respect to and merges with the surface parts 35, adjoining the longitudinal groove 23 on the longitudinal sides. The external surface 43 then together with the two surface parts 35 flanking it constitutes the surface section 17 having the form of a flat. Owing to the cover band the piston rod 8 is restored to the form it would have if there had been no groove produced therein. For instance the external surface 34 and the adjacent surface sections 35 are in a common plane, which constitutes the surface section 17.

The cover band 33 is fixedly anchored in the longitudinal groove 23. For this purpose it may with advantage be bonded in the longitudinal groove 23. Its outline as viewed radially corresponds to that of the longitudinal groove 23 so that the latter is completely shut off by the cover band 33.

The cover band 33 provides an optimum sealing off in the part where the piston rod 8 extends through the terminating wall 6 while at the same time protecting the sensitive magnetic strip 22 against damage. Since the external surface 34 of the sealing band 33 constitutes at least one part of the surface section 17 having the form of a flat, it is in contact, just like the other parts of the outer surface, when the guide and/or sensitive 13 and 14 is moved through. Since it is readily possible for the transition part between the cover band 33 and the adjacent surface sections 35 of the piston rod 8 to be so designed that there is no intermediate space or recess available, the drive fluid present in the working space 33 does not have any path to flow along past the sealing device 14. In accordance with the present example that is rendered possible because adhesive is introduced into the above mentioned transition parts 36 so that the transition parts 36 are filled with adhesive as far as the external surface and there is a smooth transition between external surface parts adjoining each other.

In order to ensure that the effectiveness of the position determining device 16 is not impaired by the cover band 33, it is expedient to manufacture the cover strip of non-magnetic material. In the illustrated working embodiment it consists of spring steel with a low permeability, which is furthermore extremely wear resistant and resistant to corrosion. Such a material is for example 13 X RM 19 steel as supplied by the Sandvik Company. Thus the cover band 33 will allow the passage of the magnetic fields of the magnetic strip 22 which may then affect the sensor device 18 in the desired fashion.

In order to obtain an exact and stepless transition between the cover band 33 and the parts adjoining same longitudinally, of the piston rod 8, the piston rod 8 is in the present example of the invention ground down after bonding the cover band 33 in place. Accordingly any lack of evenness is coped with.

The sensor device 18 is in the present case constituted by an extremely compact sensor head 37, which is very suitable for integration in the housing 1 and more particularly, as here, in the terminating wall 6 through which the piston rod 8 extends. The terminating wall 6 has here a radially extending recess 38 adjacent to the outlet opening 12, and open inwardly toward the piston rod 8 and on the other hand radially outward toward an external surface 42 of the terminating wall 6. In this recess 38 the sensor head 37, for instance in the form of a cartridge, is mounted so that it maintains the necessary distance between it and the cover band 33, which it does not touch and which is between it and the magnetic strip 22.

In the sensor head 37, as shown in chained lines, an electronic signal evaluating system 43 is mounted, which evaluates the signals of the semiconductor sensors in the necessary manner. It would however also be conceivable to have an arrangement in which the evaluating electronic system would be to the outside and for example would belong to the processing device 24.

The surface section 17 having the form of a flat cooperates with the guide section 44 in flat contact with it, of the guide device in providing a means preventing twist of the piston rod 8 in relation to the terminating wall 6. Accordingly it is possible to ensure that the sensor device 18 and the magnetic strip 22 always have the correct association with each other.

It has been found to be more particularly advantageous to provide a square piston rod 8, one of its four flat external surfaces 45 constituting the surface section 17 having the form of a flat. Such a design is adopted in the working example, the square section of the piston rod 8 being exactly square, i.e. not just square in the sense of being rectangular. If required would be possible to integrate a further scale more particularly in the form of a magnetic strip, which would also cooperate with a sensor device. Accordingly it is possible to provide a mutually coupled or a mutually independent multiple evaluation.

It would also be possible to provide still further forms of piston rod cross section, which would have at least one flat surface section. These could for example be rods with a triangular cross section or round cross section rods with flats.

Thus the working embodiment provides for the integration of a displacement measuring system with a measurement means in the form of a magnetized magnetic strip having an alternation of the poles and a sensor head belonging thereto in a fluid power cylinder locked to prevent twist thereof. The cross section of the piston rod has at least one linear flank part, into which a longitudinal groove is set, which receives the magnetic strip secured by means of the high strength adhesive. The non-magnetic cover strip, which allows the passage of a magnetic field has the properties of stainless, low permeability steel which lead to a triboligically compatible covering action for the magnetic strip and the strip is held in position by the high strength adhesive.

As a sensor head in the present arrangement it is possible for example to utilize a read head of the type Sony PL 20. The lattice constant for the division of the magnetic strip into individual magnetic field zones is for example 5 mm. For scanning it is possible, when necessary, to utilize more than two semiconductor sensors.

The magnetic strip and the cover band are preferably bonded one after the other and independently in the longitudinal groove.

I claim:

1. A fluid power cylinder comprising a housing, a piston in said cylinder adapted to move axially therein, a piston rod, said piston rod being connected with said piston and extending from at least one end of the cylinder, said piston rod possessing on the external periphery thereof, at least one surface section extending in the axial direction and having the form of a flat, a longitudinal groove being provided in said flat surface section, and a measuring scale received in said groove and being capable of being scanned by a sensor device integral with the housing, wherein said measuring scale is embodied in the form of a magnetic strip which comprises a plurality of magnetic zones arranged in alternating succession and magnetized with axially alternating poles, which may be sensed by the sensor device without contact and wherein the magnetic strip is covered by a relatively thin cover band fixed to the piston rod and consisting of a material allowing the passage of a magnetic field, whose external surface facing away from the magnetic strip constitutes at least a part of the surface section of the piston rod having the form of a flat and further wherein the magnetic strip has a relatively wide upper surface in comparison to the flat surface section of the piston rod to produce a strong magnetic field able to be readily sensed by the sensor device.

2. The fluid power cylinder as set forth in claim 1, wherein said cover band is at least partially set into said longitudinal groove.

3. The fluid power cylinder as set forth in claim 2, wherein said cover band is completely sunk into said longitudinal groove, an external surface thereof merging in a flush manner with laterally adjoining piston rod parts of the surface section having the form of a flat.

4. The fluid power cylinder as set forth in claim 1, wherein said cover band consists of a material of low magnetic permeability.

5. The fluid power cylinder as set forth in claim 1, wherein said cover band consists of non-magnetic material.

6. The fluid power cylinder as set forth in claim 1, wherein said cover band consists of a wear resistant and corrosion resistant metal.

7. The fluid power cylinder as set forth in claim 1, wherein said magnetic strip is a plastic strip containing magnetizable components.

8. The fluid power cylinder as set forth in claim 1, wherein said magnetic strip is attached to a support strip and is positioned between such support strip and the cover band.

9. The fluid power cylinder as set forth in claim 8, wherein said support strip consists of metallic material not able to be magnetized.

10. The fluid power cylinder as set forth in claim 1, wherein said individual magnet zones are aligned axially and in the longitudinal direction of the piston rod, axially adjacent magnet zones with the same poles being arranged adjacent to each other.

11. The fluid power cylinder as set forth in claim 1, wherein said magnetic strip is adhesively attached in said longitudinal groove.

12. The fluid power cylinder as set forth in claim 1, wherein said cover band is secured by bonding on the piston rod.

13. The fluid power cylinder as set forth in claim 1, wherein the surface section of the piston rod having the form of a flat is ground flat with the cover band inserted in the longitudinal groove.

14. The fluid power cylinder as set forth in claim 1, wherein said piston rod possesses a plurality of such surface sections having the form of a flat, at least one of such surface sections having a magnetic strip with a cover band associated with it.

15. The fluid power cylinder as set forth in claim 14, wherein said piston rod has a rectangular cross section.

16. The fluid power cylinder as set forth in claim 1, wherein said sensor device comprises a sensor head placed in the interior of a terminating wall, through which the piston rod extends, of the housing.

17. The fluid power cylinder as set forth in claim 16, comprising an electronic signal evaluating device integrated in said sensor head.

18. A fluid power cylinder comprising:

a housing having an internal working space;

a piston adapted to be axially movable within the working space; and a piston rod connected to said piston and extending from at least one end of the housing; wherein the piston rod includes at least one planar surface, a longitudinal groove being provided therein, and a measuring scale in the form of a magnetic strip being positioned in the groove, the magnetic strip comprising a plurality of alternating magnetic zones arranged longitudinally thereon, and a sensor device for contactless sensing of a position of the piston rod, the magnetic strip being relatively wide in respect to the planar piston rod surface and further being closely positioned to a top surface of the planar piston rod surface to produce a strong magnetic field to be sensed by the sensor device.

19. A fluid power cylinder as set forth in claim 18, further comprising a cover band positioned over said magnetic strip, said cover band comprising a material which allows the passage of magnetic fields therethrough, said cover band being flush with the planar surface of the piston rod.

20. A fluid power cylinder as set forth in claim 19, further comprising a support strip, said magnetic strip being attached to said support strip, the support strip being adapted to be mounted in the longitudinal groove in the piston rod.

* * * * *